US009469890B2

(12) United States Patent
Bengtsson

(10) Patent No.: US 9,469,890 B2
(45) **Date of Patent: *Oct. 18, 2016**

(54) IRON VANADIUM POWDER ALLOY

(75) Inventor: Sven Bengtsson, Höganäs (SE)

(73) Assignee: HOGANAS AB (Publ), Hoganas (SE)

( * ) Notice: Subject to any disclaimer, the term of this patent is extended or adjusted under 35 U.S.C. 154(b) by 825 days.

This patent is subject to a terminal disclaimer.

(21) Appl. No.: 13/254,053

(22) PCT Filed: Mar. 15, 2010

(86) PCT No.: PCT/SE2010/050282

§ 371 (c)(1),
(2), (4) Date: Sep. 9, 2011

(87) PCT Pub. No.: WO2010/107372

PCT Pub. Date: Sep. 23, 2010

(65) Prior Publication Data

US 2011/0318214 A1 Dec. 29, 2011

Related U.S. Application Data

(60) Provisional application No. 61/161,838, filed on Mar. 20, 2009.

(30) Foreign Application Priority Data

Mar. 20, 2009 (SE) ..... 0950180

(51) Int. Cl.

| | |
|---|---|
| ***C22C 33/02*** | (2006.01) |
| ***B22F 1/00*** | (2006.01) |
| ***C22C 38/00*** | (2006.01) |
| ***C22C 38/04*** | (2006.01) |
| ***C22C 38/12*** | (2006.01) |
| ***C22C 38/16*** | (2006.01) |

(52) U.S. Cl.

CPC ..... *C22C 33/0264* (2013.01); *B22F 1/007* (2013.01); *C22C 38/002* (2013.01); *C22C 38/004* (2013.01); *C22C 38/04* (2013.01); *C22C 38/12* (2013.01); *C22C 38/16* (2013.01); *B22F 2998/10* (2013.01); *B22F 2999/00* (2013.01)

(58) Field of Classification Search

CPC ... C22C 33/0264; C22C 38/04; C22C 38/12; B22F 1/0059; B22F 1/007

USPC ..... 419/11

See application file for complete search history.

(56) References Cited

U.S. PATENT DOCUMENTS

| | | | | |
|---|---|---|---|---|
| 3,901,661 | A | 8/1975 | Kondo et al. | |
| 4,069,044 | A | 1/1978 | Mocarski et al. | |
| 4,266,974 | A | 5/1981 | Nitta et al. | |
| 5,571,305 | A * | 11/1996 | Uenosono et al. | 75/246 |
| 5,605,559 | A | 2/1997 | Unami et al. | |
| 6,027,544 | A | 2/2000 | Arvidsson | |
| 6,348,080 | B1 | 2/2002 | Arvidsson et al. | |
| 8,398,739 | B2 * | 3/2013 | Bengtsson et al. | 75/252 |
| 2003/0033904 | A1 | 2/2003 | Ilia | |
| 2003/0196511 | A1 | 10/2003 | Ilia | |
| 2006/0086204 | A1 | 4/2006 | Ilia et al. | |

FOREIGN PATENT DOCUMENTS

| | | | |
|---|---|---|---|
| EP | 0 808 681 | A1 | 11/1997 |
| EP | 1 068 915 | A1 | 1/2001 |
| JP | 59-93801 | A | 5/1984 |
| JP | 61-253301 | A | 11/1986 |
| WO | WO 03/106079 | A1 | 12/2003 |

OTHER PUBLICATIONS

International Search Report (PCT/ISA/210) issued on Jun. 28, 2010, by Swedish Patent Office as the International Searching Authority for International Application No. PCT/SE2010/050282.

Written Opinion (PCT/ISA/237) issued on Jun. 28, 2010, by Swedish Patent Office as the International Searching Authority for International Application No. PCT/SE2010/050282.

* cited by examiner

*Primary Examiner* — Weiping Zhu

(74) *Attorney, Agent, or Firm* — Buchanan Ingersoll & Rooney P.C.

(57) ABSTRACT

A water atomized prealloyed chromium-free, iron-based steel powder is provided which comprises by weight-%: 0.05-0.4 V, 0.09-0.3 Mn, less than 0.1 Cr, less than 0.1 Mo, less than 0.1 Ni, less than 0.2 Cu, less than 0.1 C, less than 0.25 O, and less than 0.5 of unavoidable impurities, with the balance being iron.

26 Claims, No Drawings

IRON VANADIUM POWDER ALLOY

FIELD OF THE INVENTION

The present invention concerns an iron-based vanadium containing powder being essentially free from chromium, molybdenum and nickel, as well as a powder composition containing the powder and other additives, and a powder forged component made from the powder composition. The powder and powder composition is designed for a cost effective production of powder sintered and alternatively forged parts.

BACKGROUND OF THE INVENTION

In industries the use of metal products manufacturing by compaction and sintering metal powder compositions is becoming increasingly widespread. A number of different products of varying shape and thickness are being produced and the quality requirements are continuously raised at the same time as it is desired to reduce the cost. As net shape components, or near net shape components requiring a minimum of machining in order to reach finished shape, are obtained by press and sintering of iron powder compositions in combination with a high degree of material utilisation, this technique has a great advantage over conventional techniques for forming metal parts such as moulding or machining from bar stock or forgings.

One problem connected to the press and sintering method is, however, that the sintered component contains a certain amount of pores reducing the strength of the component. Basically there are two ways to overcome the negative effect on mechanical properties caused by the component porosity. 1) The strength of the sintered component may be increased by introducing alloying elements such as carbon, copper, nickel, molybdenum etc. 2) The porosity of the sintered component may be reduced by increasing the compressibility of the powder composition, and/or increasing the compaction pressure for a higher green density, or increasing the shrinkage of the component during sintering. In practise, a combination of strengthening the component by addition of alloying elements and minimising the porosity is applied.

Chromium serves to strengthen the matrix by solid solution hardening, increase hardenability, oxidation resistance and abrasion resistance of a sintered body. However, chromium containing iron powders can be difficult to sinter, as they often require high temperature and very well controlled atmospheres.

The present invention relates to an alloy excluding chromium, i.e. having no intentional content of chromium. This results in lower requirements on sintering furnace equipment and the control of the atmosphere compared to when sintering chromium containing materials.

Powder forging includes rapid densification of a sintered preform using a forging strike. The result is a fully dense net shape part, or near net shape part, suitable for high performance applications. Typically, powder forged articles have been manufactured from iron powder mixed with copper and graphite. Other types of materials suggested include iron powder prealloyed with nickel and molybdenum and small amounts of manganese to enhance iron hardenability without developing stable oxides. Machinability enhancing agents such as MnS are also commonly added.

Carbon in the finished component will increase the strength and hardness. Copper melts before the sintering temperature is reached thus increasing the diffusion rate and promoting the formation of sintering necks. Addition of copper will improve the strength, hardness and hardenability.

Connecting rods for internal combustion engines have successfully been produced by the powder forging technique. When producing connecting rods using powder forging, the big end of the compacted and sintered component is usually subjected to a fracture split operation. Holes and threads for the big end bolts are machined. An essential property for a connecting rod in a internal combustion engine is high compressive yield strength as such connecting rod is subjected to compressive loadings three times as high as the tensile loadings. Another essential material property is an appropriate machinability as holes and threads have to be machined in order to connect the split big ends after mounting. However, connecting rod manufacture is a high volume and price sensitive application with strict performance, design and durability requirements. Therefore materials or processes that provide lower costs are highly desirable.

U.S. Pat. No. 3,901,661, U.S. Pat. No. 4,069,044, U.S. Pat. No. 4,266,974, U.S. Pat. No. 5,605,559, U.S. Pat. No. 6,348,080 and WO 03/106079 describe molybdenum containing powders. When powder prealloyed with molybdenum is used to produce pressed and sintered parts, bainite is easily formed in the sintered part. In particular, when using powders having low contents of molybdenum, the formed bainite is coarse impairing machinability, which can be problematic in particular for connecting rods where good machinability is desirable. Molybdenum is also very expensive as alloying element.

In U.S. Pat. No. 5,605,559 a microstructure of fine pearlite has been obtained with a Mo-alloyed powder by keeping Mn very low. However, keeping the Mn content low can be expensive, in particular when using inexpensive steel scrap in the production, since steel scrap often contains Mn of 0.1 wt-% and above. Furthermore Mo is an expensive alloying element. Thus, the powder produced accordingly will be comparably expensive, due to low Mn content and the cost for Mo.

US 2003/0033904, US 2003/0196511 and US2006/086204, describe powders useful for the production of powder forged connecting rods. The powders contain prealloyed iron-based, manganese and sulphur containing powders, mixed with copper powder and graphite. US 2006/086204 describes a connecting rod made from a mixture of iron powder, graphite, manganese sulfide and copper powder. The highest value of compressive yield strength, 775 MPa, was obtained for a material having 3 wt-% Cu and 0.7 wt-% of graphite. The corresponding value for hardness was 34.7 HRC, which corresponds to about 340 HV1. A reduction of the copper and carbon contents also will lead to reduced compressive yield strength and hardness U.S. Pat. No. 5,571,305 describe a powder having excellent machinability. Sulphur and chromium are actively used as alloying elements.

OBJECTS OF THE INVENTION

An object of the invention is to provide an alloyed iron-based vanadium containing powder, being essentially free from chromium, molybdenum and nickel, and being suitable for producing as-sintered and optionally powder forged components such as connection rods.

Another object of the invention is to provide a powder capable of forming powder forged components having a high compressive yield stress, CYS, in combination with relatively low Vickers hardness, allowing the as-sintered and optionally powder forged part to be easily machined still being strong enough. A CYS/Hardness (HV1) ratio above 2.25 is desired, preferably above 2.30, while having a CYS value of at least 830 MPa and hardness HV1 of at most 420.

Another object of the invention is to provide a powder sintered and alternatively forged part, preferably a connecting rod, having the above mentioned properties.

SUMMARY OF THE INVENTION

At least one of these objects is accomplished by:

A water atomized low alloyed steel powder which comprises by weight-%: 0.05-0.4 V, 0.09-0.3 Mn, less than 0.1 Cr, less than 0.1 Mo, less than 0.1 Ni, less than 0.2 Cu, less than 0.1 C, less than 0.25 O, less than 0.5 of unavoidable impurities, with the balance being iron.

An iron-based steel powder composition based on the steel powder having, by weight-% of the composition: 0.35-1 C in the form of graphite, and optionally 0.05-2 lubricant and/or 1.5-4 Cu in the form of copper powder, and/or 1-4 Ni in the form of nickel powder; and optionally hard phase materials and machinability enhancing agents.

A method for producing sintered and optionally powder forged component comprising the steps of:

a) preparing an iron-based steel powder composition of the above composition, b) subjecting the composition to compaction between 400 and 2000 MPa to produce a green component, c) sintering the obtained green component in a reducing atmosphere at temperature between 1,000-1,400° C., and d) optionally forging the heated component at a temperature above 500° C., or subject the obtained sintered component to heat treatment.

A component made from the composition.

The steel powder has low and defined contents of manganese and vanadium and being essentially free from chromium, molybdenum and nickel and has shown to be able to provide a component that has a compressive yield stress vs. hardness ratio above 2.25, while having a CYS value of at least 830 MPa and hardness HV1 of at most 420.

DETAILED DESCRIPTION OF THE INVENTION

Preparation of the Iron-Based Alloyed Steel Powder.

The steel powder is produced by water atomization of a steel melt containing defined amounts of alloying elements. The atomized powder is further subjected to a reduction annealing process such as described in the U.S. Pat. No. 6,027,544; herewith incorporated by reference. The particle size of the steel powder could be any size as long as it is compatible with the press and sintering or powder forging processes. Examples of suitable particle size is the particle size of the known powder ABC100.30 available from Höganäs AB, Sweden, having about 10% by weight above 150 μm and about 20% by weight below 45 μm.

Contents of the Steel Powder

Manganese will, as for chromium, increase the strength, hardness and hardenability of the steel powder. Also, if the manganese content is too low, it is not possible to use inexpensive recycled scrap, unless a specific treatment for the reduction during the course of the steel manufacturing is carried out, which increases costs. Furthermore manganese may react with some of the present oxygen, thereby reducing any formation of vanadium oxides. Therefore, manganese content should not be lower than 0.09% by weight, preferably not lower than 0.1 wt %. A manganese content above 0.3 wt-% may increase the formation of manganese containing inclusion in the steel powder and may also have a negative effect on the compressibility due to solid solution hardening and increased ferrite hardness, preferably the content of manganese is at most 0.20 wt %, more preferably at most 0.15%.

Vanadium increases the strength by precipitation hardening. Vanadium has also a grain size refining effect and is believed in this context to contribute to the formation of the desirable fine grained pearlitic/ferritic microstructure. At higher vanadium contents the size of vanadium carbide and nitride precipitates increases, thereby impairing the characteristics of the powder. Furthermore, a higher vanadium content facilitates oxygen pickup, thereby increasing the oxygen level in a component produced by the powder. For these reason the vanadium should be at most 0.4% by weight. A content below 0.05% by weight will have an insignificant effect on desired properties. Therefore, the content of vanadium should be between 0.05% and 0.4% by weight, preferably between 0.1% and 0.35% by weight, more preferably between 0.25 and 0.35% by weight.

The oxygen content is at most 0.25 wt-%, a too high content of oxides impairs strength of the sintered and optionally forged component, and impairs the compressibility of the powder. For these reasons, oxygen is preferably at most 0.18 wt-%.

Nickel should be less than 0.1 wt-% preferably less than 0.05% by weight, more preferably less than 0.03% by weight. Copper should be less than 0.2 wt-%, preferably less than 0.15% by weight, more preferably less than 0.1% by weight. Chromium should be less than 0.1 wt-%, preferably less than 0.05% by weight, more preferably less than 0.03% by weight. To prevent bainite to be formed as well as to keep costs low, since molybdenum is a very expensive alloying element, molybdenum should be less than 0.1 wt-%, preferably less than 0.05% by weight, more preferably less than 0.03% by weight. None of these elements (Ni, Cu, Cr, Mo) are needed but could be tolerated below the above mentioned levels.

Carbon in the steel powder should be at most 0.1% by weight, preferably less than 0.05% by weight, more preferably less than 0.02% by weight, most preferably less than 0.01% by weight, and nitrogen should be at most 0.1% by weight, preferably less than 0.05% by weight, more preferably less than 0.02% by weight, most preferably less than 0.01% by weight. Higher contents of carbon and nitrogen will unacceptably reduce the compressibility of the powder.

Besides the above mentioned elements, the total amount of unavoidable impurities such as phosphorous, silicon, aluminium, sulphur and the like should be less than 0.5% by weight in order not to deteriorate the compressibility of the steel powder or act as formers of detrimental inclusions, preferably less than 0.3 wt-%. Among unavoidable impurities, sulphur should be less than 0.05%, preferably less than 0.03%, and most preferably less than 0.02% by weight, since it could form FeS that would alter the melting point of the steel and thus impair the forging process. In addition, sulphur is known to stabilize free graphite in steel, which would influence the ferritic/pearlitic structure of the sintered component. Other unavoidable impurities should each be less than 0.10%, preferably less than 0.05%, and most preferably less than 0.03% by weight, in order not to deteriorate the compressibility of the steel powder or act as formers of detrimental inclusions.

Powder Composition

Before compaction, the iron-based steel powder is mixed with graphite, and optionally with copper powder and/or lubricants and/or nickel powder, and optionally with hard phase materials and machinability enhancing agents.

In order to enhance strength and hardness of the sintered component, carbon is introduced in the matrix. Carbon, C, is added as graphite in amount between 0.35-1.0% by weight of the composition, preferably 0.5-0.8% by weight. An amount less than 0.35 wt % C will result in a too low strength and an amount above 1.0 wt % C will result in an excessive formation of carbides yielding a too high hardness and impair the machinability properties. For the same reason, the preferred added amount of graphite is 0.5-0.8% by weight. If, after sintering or forging, the component is to be heat treated according to a heat treatment process including carburising; the amount of added graphite may be less than 0.35%.

Lubricants are added to the composition in order to facilitate the compaction and ejection of the compacted component. The addition of less than 0.05% by weight of the composition of lubricants will have insignificant effect and the addition of above 2% by weight of the composition will result in a too low density of the compacted body. Lubricants may be chosen from the group of metal stearates, waxes, fatty acids and derivates thereof, oligomers, polymers and other organic substances having lubricating effect.

Copper, Cu, is a commonly used alloying element in the powder metallurgical technique. Cu will enhance the strength and hardness through solid solution hardening. Cu will also facilitate the formation of sintering necks during sintering, as copper melts before the sintering temperature is reached providing so called liquid phase sintering which is faster than sintering in solid state. The powder is preferably admixed with Cu or diffusion bonded with Cu, preferably in an amount of 1.5-4 wt-% Cu, more preferably the amount of Cu is 2.5 3.5 wt-%.

Nickel, Ni, is a commonly used alloying element in the powder metallurgical technique. Ni increases strength and hardness while providing good ductility. Unlike copper, nickel powders do not melt during sintering. This fact makes it necessary to use finer particles when admixing, since finer powders permit a better distribution via solid-state diffusion. The powder can optionally be admixed with Ni or diffusion bonded with Ni, in such cases preferably in an amount of 1-4 wt-% Ni. However, since nickel is a costly element, especially in the form of fine powder, the powder is not admixed with Ni nor diffusion bonded with Ni in the preferred embodiment of the invention.

Other substances such as hard phase materials and machinability enhancing agents, such as MnS, $MoS_2$, $CaF_2$, different kinds of minerals etc. may be added.

Sintering

The iron-based powder composition is transferred into a mould and subjected to a compaction pressure of about 400-2000 MPa to a green density of above about 6.75 g/cm$^3$. The obtained green component is further subjected to sintering in a reducing atmosphere at a temperature of about 1000-1400° C., preferably between about 1100-1300° C.

Post Sintering Treatments

The sintered component may be subjected to a forging operation in order to reach full density. The forging operation may be performed either directly after the sintering operation when the temperature of the component is about 500-1400° C., or after cooling of the sintered component, the cooled component is then reheated to a temperature of about 500-1400° C. before the forging operation.

The sintered or forged component may also be subjected to a hardening process, for obtaining desired microstructure, by heat treatment and by controlled cooling rate. The hardening process may include known processes such as case hardening, nitriding, induction hardening, and the like. In case that heat treatment includes carburizing the amount of added graphite may be less than 0.35%.

Other types of post sintering treatments may be utilized such as surface rolling or shot peening, which introduces compressive residual stresses enhancing the fatigue life.

Properties of the Finished Component

In contrast to the ferritic/pearlitic structure obtained when sintering components based on in the PM industry commonly used iron-copper-carbon systems, and especially for powder forging, the alloyed steel powder according to the present invention is designed to obtain a finer ferritic/pearlitic structure.

Without being bound to any specific theory it is believed that this finer ferritic/pearlitic structure contributes to higher compressive yield strength, compared to materials obtained from an iron/copper/carbon system, at the same hardness level. The demand for improved compressive yield strength is especially pronounced for connecting rods, such as powder forged connecting rods. At the same time it shall be possible to machine the connecting rod materials in an economical manner, therefore the hardness of the material must be relatively low. The present invention provides a new low alloyed material having high compressive yield strength, in combination with a low hardness value resulting in a CYS/HV1-ratio above 2.25, while having a CYS value of at least 830 MPa and hardness HV1 of at most 420.

Furthermore, a too high content of oxygen in the component is undesirable since it will have a negative impact on mechanical properties. Therefore it is preferred to have an oxygen content below 0.1% by weight.

EXAMPLES

Pre-alloyed iron-based steel powders were produced by water atomizing of steel melts. The obtained raw powders were further annealed in a reducing atmosphere followed by a gently grinding process in order to disintegrate the sintered powder cake. The particle sizes of the powders were below 150 μm. Table 1 shows the chemical compositions of the different powders.

TABLE 1

| Powder | Mn [wt %] | V [wt %] | C [wt %] | O [wt %] | N [wt %] | S [wt %] |
|---|---|---|---|---|---|---|
| A | 0.09 | 0.14 | 0.004 | 0.11 | 0.006 | 0.001 |
| B | 0.11 | 0.05 | 0.003 | 0.13 | 0.001 | 0.003 |
| C | 0.13 | 0.20 | 0.004 | 0.18 | 0.002 | 0.004 |
| D | 0.09 | 0.46 | 0.002 | 0.19 | 0.002 | 0.001 |
| F | 0.12 | 0.28 | 0.005 | 0.20 | 0.007 | 0.003 |
| G | 0.17 | 0.20 | 0.004 | 0.17 | 0.003 | 0.004 |
| Ref. | <0.01 | <0.01 | N.A. | N.A. | N.A. | N.A. |

Table 1 shows the chemical composition of the steel powders.

The obtained steel powders A-G were mixed with graphite UF4, from Kropfmühl, according to the amounts specified in table 2, and 0.8% by weight of Amide Wax PM, available from Höganäs AB, Sweden. Copper powder Cu-165 from A Cu Powder, USA, was added, according to the amounts specified in table 2.

As reference an iron-copper carbon composition was prepared, based on the iron powder ASC100.29, available from Höganäs AB, Sweden, and the same quantities of graphite and copper according to the amounts specified in table 2. Further, 0.8% by weight of Amide Wax PM, available from Höganäs AB, Sweden, was added to Ref. 1, Ref. 2 and Ref. 3, respectively.

The obtained powder compositions were transferred to a die and compacted to form green components at a compaction pressure of 490 MPa. The compacted green components were placed in a furnace at a temperature of 1120° C. in a reducing atmosphere for approximately 40 minutes. The sintered and heated components were taken out of the furnace and immediately thereafter forged in a closed cavity to full density. After the forging process the components were allowed to cool in air at room temperature.

The forged components were machined into compressive yield strength specimens according to ASTM E9-89c and tested with respect to compressive yield strength, CYS, according to ASTM E9-89c.

Hardness, HV1, was tested on the same components according to EN ISO 6507-1 and chemical analyses with respect to copper, carbon and oxygen were performed on the compressive yield strength specimens.

The following table 2 shows added amounts of graphite to the composition before producing the test samples. It also shows chemical analyses for C, Cu, and O of the test samples. The amount of analysed Cu of the test samples corresponds to the amount of admixed Cu-powder in the composition. The table also shows results from CYS and hardness tests for the samples.

TABLE 2

| Powder Composition | Added Graphite [wt %] | Cu [wt %] | C [wt %] | O [wt %] | CYS [MPa] | Hardness, HV1 | CYS/HV1 Ratio |
|---|---|---|---|---|---|---|---|
| A1 | 0.6 | 3.0 | 0.5 | 0.02 | 891 | 374 | 2.38 |
| A2 | 0.7 | 3.0 | 0.6 | 0.02 | 938 | 401 | 2.34 |
| B1 | 0.6 | 3.0 | 0.5 | 0.05 | 700 | 266 | 2.63 |
| B2 | 0.7 | 3.0 | 0.6 | 0.05 | 850 | 371 | 2.29 |
| C1 | 0.6 | 3.0 | 0.5 | 0.03 | 900 | 355 | 2.53 |
| C2 | 0.7 | 3.0 | 0.6 | 0.03 | 950 | 380 | 2.50 |
| D1 | 0.6 | 3.0 | 0.5 | 0.14 | N.A. | N.A. | N.A. |
| D2 | 0.7 | 3.0 | 0.6 | 0.12 | N.A. | N.A. | N.A. |
| F1 | 0.6 | 3.0 | 0.5 | 0.04 | 1030 | 338 | 3.04 |
| F2 | 0.7 | 3.0 | 0.6 | 0.06 | 1080 | 359 | 3.00 |
| G1 | 0.6 | 3.0 | 0.5 | 0.07 | 872 | 368 | 2.37 |
| G2 | 0.7 | 3.0 | 0.6 | 0.08 | 940 | 399 | 2.36 |
| Ref. 1 | 0.6 | 2.0 | 0.5 | 0.01 | 627 | 244 | 2.57 |
| Ref. 2 | 0.6 | 3.0 | 0.5 | 0.02 | 730 | 290 | 2.51 |
| Ref. 3 | 0.7 | 3.0 | 0.6 | 0.01 | 775 | 375 | 2.06 |

Table 2 shows amount of added graphite, and analyzed C and Cu content of the produced samples as well as results from CYS and hardness testing.

Samples prepared from all compositions from A1 to F2, except B1 and Ref 1-3, provided a sufficient CYS value, above 830 MPa, in combination with a CYS/HV1 ratio above 2.25 and hardness HV1 less than 420. B1 with 0.6% by weight of added graphite did not provide a sufficient CYS value. However, when increasing the amount of added graphite to 0.7% by weight the CYS value comes above 830 MPa, while the CYS/HV1 ratio reaches the wider target (2.25) but comes below the preferred ratio (2.30). It can therefore be concluded that the lower limit of vanadium content is somewhere close to 0.05% by weight. It is however preferred to have a vanadium content above 0.1 wt %.

For samples D1 and D2 the amount of oxygen in the finished samples is above 0.1 weight-%, which is undesirable since high oxygen levels can impair mechanical properties. This is believed to be caused by the vanadium content above 0.4% by weight since vanadium has a high affinity to oxygen. Therefore, vanadium contents above 0.4 weight-% are undesirable.

As can be seen in the table, samples F1 and F2 show very good results.

Samples G1 and G2 demonstrate that even if a content of 0.17 weight-% manganese provides acceptable results it is preferable to keep the level below 0.15 weight-%, as in samples C1 and C2, for which the results are better.

Samples prepared from Ref 1-3 compositions exhibit a too low compressive yield stress, despite a relative high carbon and copper content. Further increase of carbon and copper may render a sufficient compressive yield stress, but the hardness will become too high, thus lowering the CYS/HV1 ratio further.

In another example powder compositions based on powder A and the reference powder, both of Table 1, were mixed with graphite UF4, from Kropfmühl, 0.8% by weight of Amide Wax PM, available from Höganäs AB, Sweden and optionally copper powder Cu-165 from A Cu Powder, USA according to the amounts specified in table 3. The reference powder of Table 1 being the iron powder ASC100.29, available from Höganäs AB, Sweden. Compositions A3, A4, Ref 4, and Ref 5 were without addition of copper powder and compositions A5, A6, Ref 6, and Ref 7 were admixed with 2 wt % of copper powder.

TABLE 3

| Powder Composition | Added Graphite [wt %] | Added Cu [wt %] | UTS [MPa] | YS [MPa] |
|---|---|---|---|---|
| A3 | 0.5 | | 415 | 324 |
| A4 | 0.8 | | 514 | 396 |
| A5 | 0.5 | 2.0 | 558 | 462 |
| A6 | 0.8 | 2.0 | 660 | 559 |
| Ref. 4 | 0.5 | | 340 | 215 |
| Ref. 5 | 0.8 | | 425 | 270 |
| Ref. 6 | 0.5 | 2.0 | 494 | 375 |
| Ref. 7 | 0.8 | 2.0 | 570 | 470 |

The obtained powder compositions were transferred to a die and compacted to form green components at a compaction pressure of 600 MPa. The compacted green components were placed in a furnace at a temperature of 1120° C. in a reducing atmosphere for approximately 30 minutes.

Test specimens were prepared according to SS-EN ISO 2740, which were tested according to SS-EN 1002-1 for ultimate tensile strength (UTS) and yield strength (YS).

When comparing results for Ref 4 and Ref 6 it can be seen that the YS is 160 MPa higher for Ref 6 compared to Ref 4, which corresponds to 80 MPa per added % Cu. If we compare A3 and Ref 4 we can see that the YS is 109 MPa higher for A3 compared to Ref 4, which corresponds to about 80 MPa per 0.1 wt-% of added V. This strong effect of the V addition is unexpected. Furthermore, it also holds true for powder mixes with higher carbon (A4/Ref. 5) and for mixes with both copper and carbon (A5/Ref. 6 and A6/Ref 7).

The invention claimed is:

1. A water atomised prealloyed iron-based steel powder which comprises by weight-%:

0.05-0.4 V, 0.09-0.3 Mn, less than 0.03 Cr, less than 0.1 Mo, less than 0.1 Ni, less than 0.2 Cu, less than 0.1 C, less than 0.25 O, and less than 0.5 of unavoidable impurities, with the balance being iron.

2. The powder according to claim 1, wherein the content of V is within the range of 0.1-0.35 weight-%.

3. The powder according to claim 2, wherein the content of Mn is within the range of 0.09-0.2 weight-%.

4. The powder according to claim 2, wherein the content of V is within the range of 0.2-0.35 weight-%.

5. The powder according to claim 4, wherein the content of Mn is within the range of 0.09-0.2 weight-%.

6. The powder according to claim 1, wherein the content of Mn is within the range of 0.09-0.2 weight-%.

7. The powder according to claim 1, wherein content of S is less than 0.05 weight-%.

8. The powder according to claim 1, wherein the content of Ni is less than 0.05% by weight, the content of Mo is less than 0.05% by weight, the content of Cu is less than 0.15% by weight, content of S is less than 0.03% by weight, and the total amount of incidental impurities is less than 0.3% by weight.

9. An iron-based powder composition comprising the steel powder according to claim 1 mixed with 0.35-1% by weight of the composition of graphite, and optionally 0.05-2% by weight of the composition of lubricants, and/or copper in an amount of 1.5-4% by weight, and/or nickel in an amount of 1-4%; and optionally hard phase materials and machinability enhancing agents.

10. The iron-based powder composition according to claim 9 wherein the powder is not mixed with Ni.

11. A method for producing a sintered and optionally powder forged component comprising the steps of:

a) preparing an iron-based steel powder composition according to claim 8, b) subjecting the composition to compaction between 400 and 2000 MPa, c) sintering the obtained green component in a reducing atmosphere at temperature between 1000-1400° C., and d) optionally forging the heated component at a temperature above 500<0>C or subjecting the obtained sintered component to a heat treatment step.

12. A powder forged component produced from the iron-based powder composition according to claim 10.

13. A method for producing a sintered and optionally powder forged component comprising the steps of:

a) preparing an iron-based steel powder composition according to claim 9, b) subjecting the composition to compaction between 400 and 2000 MPa, c) sintering the obtained green component in a reducing atmosphere at temperature between 1000-1400° C., and d) optionally forging the heated component at a temperature above 500<0>C or subjecting the obtained sintered component to a heat treatment step.

14. An iron-based powder composition comprising the steel powder according to claim 1, mixed with graphite.

15. The iron-based powder composition of claim 14, wherein the graphite is 0.35-1% by weight of the composition.

16. The iron-based powder composition of claim 14, wherein the iron-based powder composition consists of the steel powder according to claim 1 mixed with graphite, and optionally 0.05-2% by weight of the composition of lubricants, and/or copper in an amount of 1.5-4% by weight, and/or nickel in an amount of 1-4%; and optionally hard phase materials and machinability enhancing agents.

17. A powder forged component produced from an iron-based powder composition mixed with 0.35-1% by weight of the composition of graphite, and optionally 0.05-2% by weight of the composition of lubricants, and/or copper in an amount of 1.5-4% by weight, and/or nickel in an amount of 1-4%; and optionally hard phase materials and machinability enhancing agents, wherein the iron-based powder composition comprises a water atomised prealloyed iron-based steel powder which comprises by weight-%:

0.05-0.4 V, 0.09-0.3 Mn, less than 0.03 Cr, less than 0.1 Mo, less than 0.1 Ni, less than 0.2 Cu, less than 0.1 C, less than 0.25 O, and less than 0.5 of unavoidable impurities, with the balance being iron.

18. The powder forged component according to claim 17, wherein the component has a substantially pearlitic/ferritic microstructure.

19. The powder forged component according to claim 18, wherein the component is a connecting rod.

20. The powder forged component according to claim 18, wherein the component has compressive yield strength (CYS) of at least 830 MPa, and a ratio between compressive yield stress (CYS) and a Vickers hardness (HVI) of at least 2.25, with the compressive yield stress being in MPa when calculating the ratio.

21. The powder forged component according to claim 17, wherein the component is a connecting rod.

22. The powder forged component according to claim 21, wherein the component has compressive yield strength (CYS) of at least 830 MPa, and a ratio between compressive yield stress (CYS) and a Vickers hardness (HVI) of at least 2.25, with the compressive yield stress being in MPa when calculating the ratio.

23. The powder forged component according to claim 17, wherein the component has compressive yield strength (CYS) of at least 830 MPa, and a ratio between compressive yield stress (CYS) and a Vickers hardness (HVI) of at least 2.25, with the compressive yield stress being in MPa when calculating the ratio.

24. A water atomised prealloyed iron-based steel powder which comprises by weight-%:

0.05-0.4 V,
0.09-0.3 Mn,
less than 0.1 Cr,
0.03-0.1 Mo,
less than 0.1 Ni,
less than 0.2 Cu,
less than 0.1 C,
less than 0.25 O, and
less than 0.5 of unavoidable impurities,
with the balance being iron.

25. The water atomised prealloyed iron-based steel powder of claim 24, wherein the powder comprises by weight-% 0.03-0.1 Ni.

26. The water atomised prealloyed iron-based steel powder of claim 24, wherein the powder comprises by weight-% 0.1-0.2 Cu.

* * * * *